United States Patent [19]

Nolan

[11] Patent Number: 4,972,177

[45] Date of Patent: Nov. 20, 1990

[54] FIXTURE FOR ACTUATING ALARM UPON CHANGE TO UPRIGHT POSITION OF RECUMBENT PATIENT

[76] Inventor: Charles A. Nolan, 19821 Graystone La., San Jose, Calif. 95120

[21] Appl. No.: 864,766

[22] Filed: May 19, 1986

[51] Int. Cl.[5] ..... G08B 21/00

[52] U.S. Cl. ..... 340/573; 200/DIG. 2

[58] Field of Search ..... 340/573, 686, 687, 689, 340/575; 200/61.52, 61.47, DIG. 2; 128/774, 782

[56] References Cited

U.S. PATENT DOCUMENTS

| | | | |
|---|---|---|---|
| 3,885,576 | 5/1975 | Symmes | 340/573 X |
| 4,284,983 | 8/1981 | Lent | 340/687 X |
| 4,348,562 | 9/1982 | Florin | 340/573 X |
| 4,399,432 | 8/1983 | Lunn | 340/573 |
| 4,536,755 | 8/1985 | Holzgang et al. | 340/573 |
| 4,608,998 | 9/1986 | Murdock | 340/573 X |
| 4,617,525 | 10/1986 | Lloyd | 340/573 |

*Primary Examiner*—Joseph A. Orsino
*Assistant Examiner*—Brian R. Tumm
*Attorney, Agent, or Firm*—Jack E. Day

[57] ABSTRACT

The present invention provides an alarm when a patient, supposed to remain in a specific position, changes to one which is undesirable. For example, it could be used for patients, supposed to remain recumbent, who become upright or in a position which is preparatory to becoming upright. It can be incorporated into a cuff, vest, panty, or the like, and includes energy source, alarm, on-off switch, and one or more position-sensitive sensors with interconnecting circuitry, so that the alarm is actuated whenever the patient changes to an undesirable position. An embodiment including a plurality of sensors, appropriately interconnected, avoids false alarms by permitting positions which might actuate a single sensor. The alarm can be audible, visual, tactile or other type, and can be located on the patient or at some remote location, connected directly or by wireless.

13 Claims, 2 Drawing Sheets

FIXTURE FOR ACTUATING ALARM UPON CHANGE TO UPRIGHT POSITION OF RECUMBENT PATIENT

GENERAL DESCRIPTION OF THE INVENTION

The present invention, in general, is a device for actuating an alarm when a person, who is supposed to remain in a certain position, changes that position. More specifically, it is a fixture to be worn by persons who are supposed to remain in a recumbent position when unsupervised, for actuating an alarm to alert attendants or family when such persons arise or prepare to arise, so that adequate supervision or help can be given to them.

BACKGROUND OF THE INVENTION

Many persons who are physically able to be ambulatory do not have the capability of caring for themselves adequately when they are. Among these are small children (especially when ill), older persons suffering from some forms of senility, some mentally deranged persons, and the like. One solution to the problem is to physically restrain the person in a recumbent or supine position when an attendant is not present, or during the nightime when other members of the family are asleep. However, this is not a satisfactory solution, especially in the home, and is normally resorted to only under the most extreme circumstances.

Vitally needed is a means of alerting others when such a person raises up to a sitting or standing position, but which does not restrain them from moving normally in bed and does not generate feelings of being restrained. A number of solutions to somewhat related matters illustrate the range of efforts which have been devoted to solving these types of problems.

The first group of solutions relate to medical problems.

Creelman U S. Pat. No. 3,638,647 discloses an alarm system for alerting others, incorporating a chest harness and associated stand for actuating an alarm when a patient has suffered a momentary loss of consciousness or has slumped or fallen from a more-or-less upright stance.

Taylor U.S. Pat. No. 4,296,757 discloses an alarm system for use with small infants for alerting parents or attendants when the symptoms of Sudden Infant Death (SID) Syndrome are detected by some appropriate means.

The second group of solutions relate to automobile passengers and seat belts.

Boblitz U.S. Pat. No. 3,504,336 discloses an alarm system for multi-occupant cars that activates a signal for alerting the driver of the vehicle or an overtaking policeman that all occupants are not belted.

Spizzo U.S. Pat. No. 3,980,988 discloses a seatbelt associated alarm system for warning a driver of a vehicle that he has fallen asleep and has slumped forward.

The third group of solutions relate to posture-aid devices.

Verhaeghe U S. Pat. No. 3,582,935 discloses an alarm system based upon abdominal muscle tension which alerts a wearer when he has permitted his abdominal muscles to relax.

Hall U.S. Pat. No. 3,608,541 discloses an alarm system incorporating a harness which alerts a wearer that he has permitted his posture to deteriorate.

Palmer U.S. Pat. No. 3,670,320 discloses an alarm system which detects when a person has permitted his abdominal muscles to relax and has assumed a poor posture.

Butler U.S. Pat. No. 3,861,688 discloses a signaling device that signals when a wearer has assumed the correct stance for any of several sporting activities.

It will be seen that the above disclosures all deal with the problem of detecting and signaling a change in the physical position or condition of a person, usually from a desired to an undesirable state. However, none of them deals with the problem of keeping track of the physical position of a patient who is not able to care for himself when up and about, and who is supposed to remain in a recumbent position when unsupervised, nor do they provide for alerting family or attendants when such a patient changes to an upright position.

BRIEF DESCRIPTION OF THE PRESENT INVENTION

The present invention provides an alarm for alerting family or attendants when a patient, who is supposed to be sleeping or reclining or otherwise remaining in a supine or other recumbent position, raises to a sitting or standing position.

It accomplishes this by means of a sensing device which is actuated when a patient changes to an upright position. The sensing device consists of a position-sensitive device affixed to a belt, harness, cuff or other fixture which encircles the body or some portion of the body such as an upper arm or thigh, so that when the patient assumes an upright position, such as sitting or standing, the position-sensitive device is activated, actuating an alarm to alert those who wish or need to know this.

In a first, simple embodiment of the invention, an electrical switch means changes from a first state to a second state when a patient sits or stands upright, activating a circuit which actuates an alarm for alerting those who need or desire to know that the patient is up or is preparing to get up.

In another embodiment, a circuit containing a plurality of position-sensitive switch means is connected so that when the patient is sitting up or standing, all of the plurality of switch means are in a conducting state, activating said circuit which actuates an alarm system to alert those who need to know.

In a third embodiment of the invention, a circuit containing a multiplicity of position-sensitive switch means is connected so that when the patient is sitting up or standing, all of said multiplicity of switch means are in a conducting state, activating said circuit which actuates an alarm to alert those who need to know.

Further embodiments of the invention include the aforementioned embodiments contained in fixtures, garments, or adhesive patches which can be worn about the chest, waist, upper arm or thigh of the patient.

These and other embodiments will be more completely described hereinafter in connection with the drawings now to be described.

DETAILED DESCRIPTION OF THE INVENTION

Figure 1:
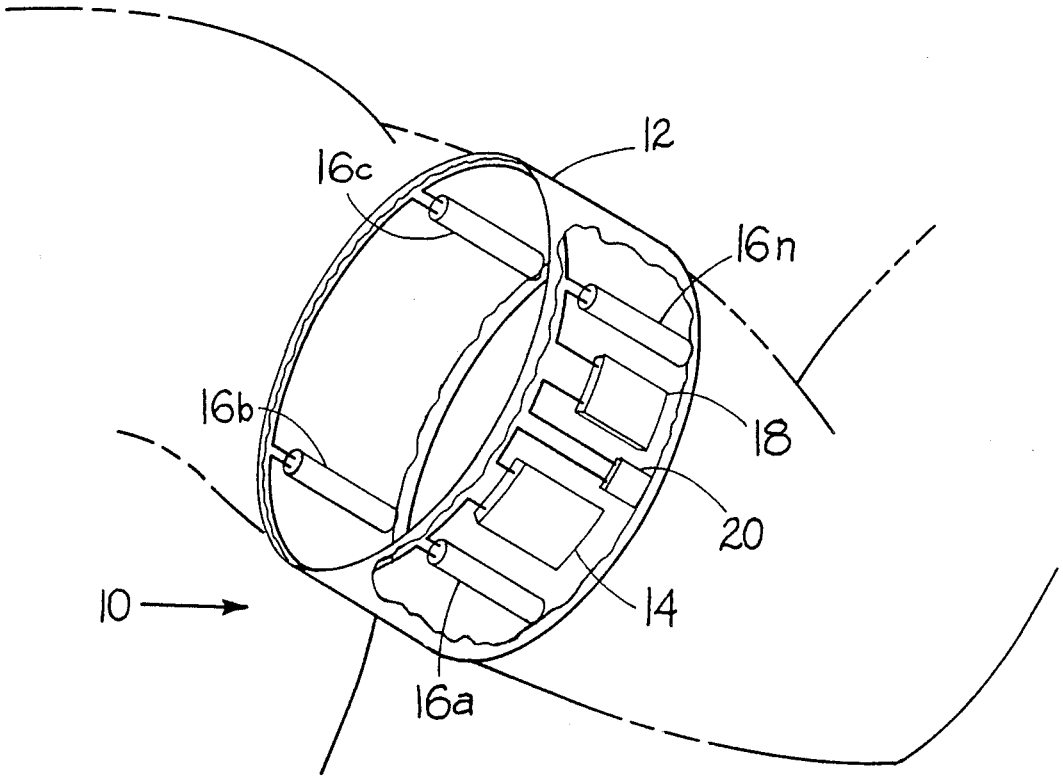
FIG. 1 is a general view of an arm-cuff fixture containing the invention.
Figure 2:
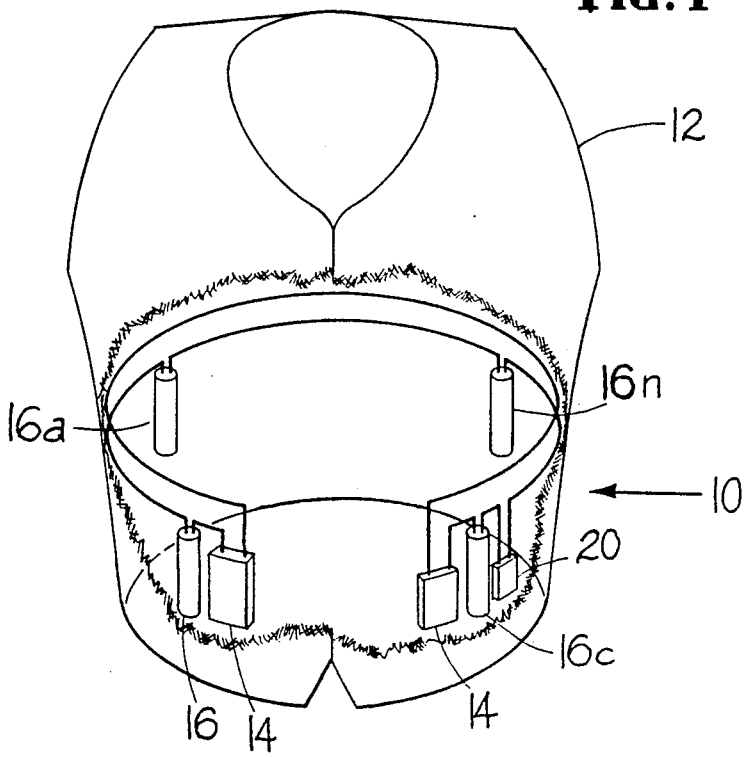
FIG. 2 is a general view of a vest version of a fixture containing the invention.

In FIG. 1, we see an embodiment of the present invention 10, contained in a fixture 12. Fixture 12 can be an arm-cuff as here), a vest (FIG. 2), a strap or harness, a waistcoat, or shorts, panties, nightgowns or the like garments or fixtures, and contains the components of the circuitry of the invention as described hereinafter and as disclosed in FIGS. 3,4 and 5. It can be worn about the trunk—preferably the chest (as in FIG. 2)—,-the upper arm or thigh, depending upon how soon attendants or family need to be alerted when the patient starts to get out of bed. That is, if those concerned want to know immediately if the patient even sits up, the invention should be located as high on the body as possible (the upper chest under the armpits, or the upper arm), so that when that part of the body becomes more-or-less upright, the invention is activated and an alarm means is actuated, as hereinafter described. Such a result might best be obtained by having the circuitry of the invention, as disclosed in FIGS. 3,4 and 5, and as hereinafter described in greater detail, contained in a vest or waistcoat, or around the upper part of pajama tops or nightgown. On the other hand, if the patient, when up, is not likely to get into any serious problem, the alarm need not be actuated until the patient is up and about, and the circuitry might be located in a cuff around the thigh, a belt around the waist, or even in shorts, panties or pajama bottoms.

Figure 3:
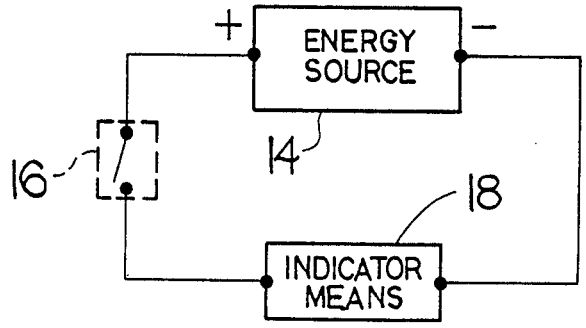
FIG. 3 is a simplified circuit schematic of the invention.

Turning now to FIG. 3, we see a simplified circuit of the invention, including energy source means 14, position-sensitive switch means 16, and indicator means 18. When switch means 16 is in any physical position other than one which corresponds to an upright stance of the patient, it is in a first state, the electrical circuit is not operative, and indicator means 18 is not actuated. When switch means 16 is in a position which corresponds to a more-or-less upright stance of the patient, or at least of his upper body or arm, it is in a second state, and actuates alarm means 18.

Obviously, the circuit of FIG. 3, while useful, has several shortcomings for the intended application of the invention:

it does not make any provision for inactivating the circuitry when it is not needed;

it does not take into account the fact that most position-sensitive switches do not have to be exactly vertical before changing from one state to another, and may be more sensitive in some orientations than others; and it does not make provision for a wearer turning to a position that could change the state of switch means 14 momentarily, giving a false alarm.

Figure 4:
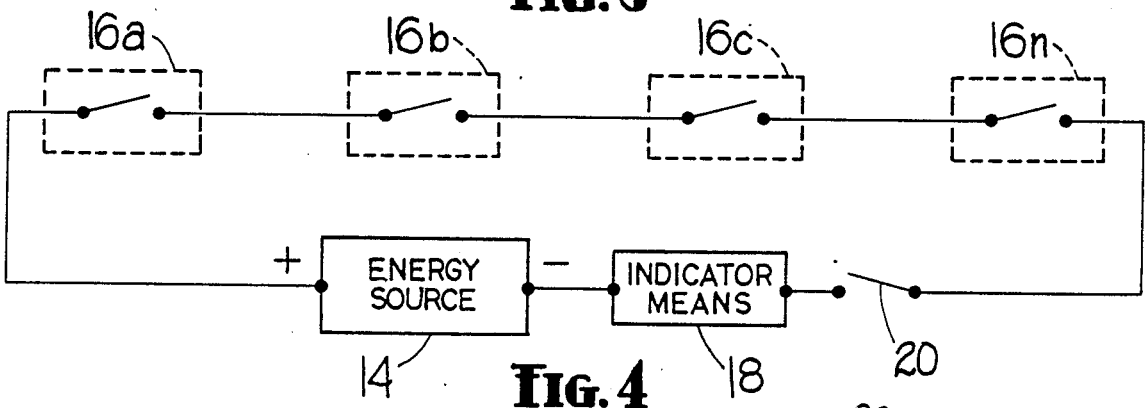
FIG. 4 is a circuit schematic of a preferred embodiment of the invention.

FIG. 4 discloses a circuit which overcomes the limitations of the circuit of FIG. 3. It includes simple on-off switch 20 to enable it to be inactivated when not in use. It further includes at least a a plurality of switch means 16*a* and 16*b*, arranged in series, and their physical placement with respect to each other on the patient's body is 90 degrees, i.e., one of the switches is mounted on the front or back of the patient's body, and the other is mounted on either side. The preferred embodiment, disclosed in FIG. 4, includes a multiplicity (preferably four or more) of switch means 16*a* . . . 16*n*, physically arranged in the fixture 12 so that they are more-or-less evenly spaced about the circumference of the body when the fixture 12 is worn.

If switch means 16*a* . . . 16*n* is more sensitive in some physical orientations than in others, this can be offset by mounting the several switches with the sam physical orientation on the fixture 12 where it is stretched out flat, so that when fixture 12 is placed about the body of a patient, each of switch means 16*a* . . . 16*n* will have a different orientation about the body axis, depending upon their location on the patient's body. This solution will also solve the problem of some switches being more sensitive than others to position, and of a wearer momentarily assuming a position in bed which would change a single switch from one state to another, and actuate a false alarm.

Position-sensitive switch means 16*a* . . . 16*n* can be any of several well-known designs, which are intended to change from a first state to a second when the switch is in a particular position. Probably the most well-known position-sensitive switch is the mercury switch, which remains in a first state until the body of the switch has a certain orientation in space, at which time the switch changes to its second state.

Obviously, since switch means 16*a* . . . 16*n* is mounted either in a garment or in a separate fixture intended to be worn under or over regular sleeping garments, its physical bulk should not be such that it will interfere with the patient's sleep or normal recumbent position.

Figure 6:
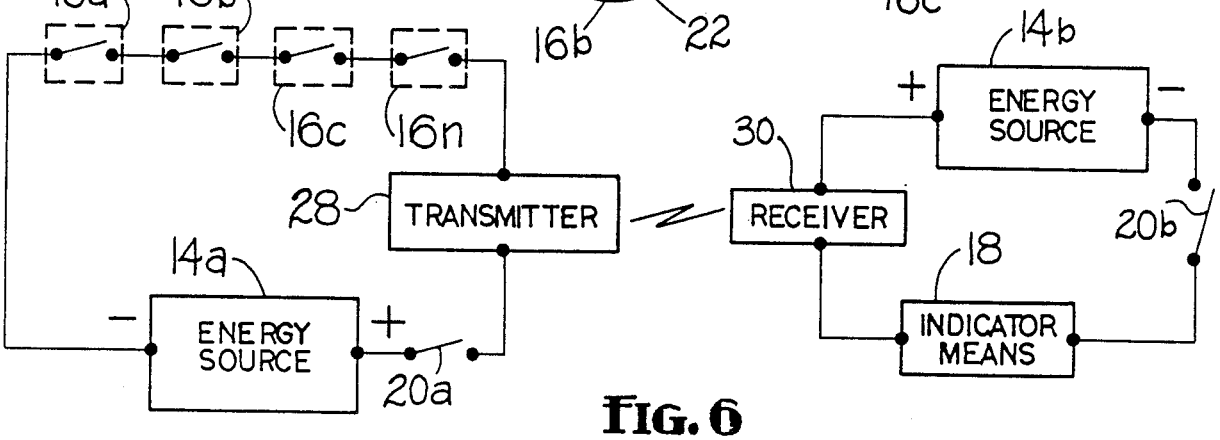
FIG. 6 is a simplified block diagram of a wireless embodiment of the present invention.

Alarm means 18 is a simple buzzer or other perceptible signal, such as a visual or tactile device. If it is desired not to alert the patient to the fact that fixture 12 contains the means of his being returned to bed, alarm means 18 can include a transmitter means 28 mounted in fixture 12, broadcasting to a receiver means 30 located as desired to alert the family or attendants, as disclosed in FIG. 6. Of course, alarm means 18 could be located at the end of a long cord, at a distance from the patient, but then the freedom of movement afforded by the invention as described hereinbefore would be limited.

Figure 5:
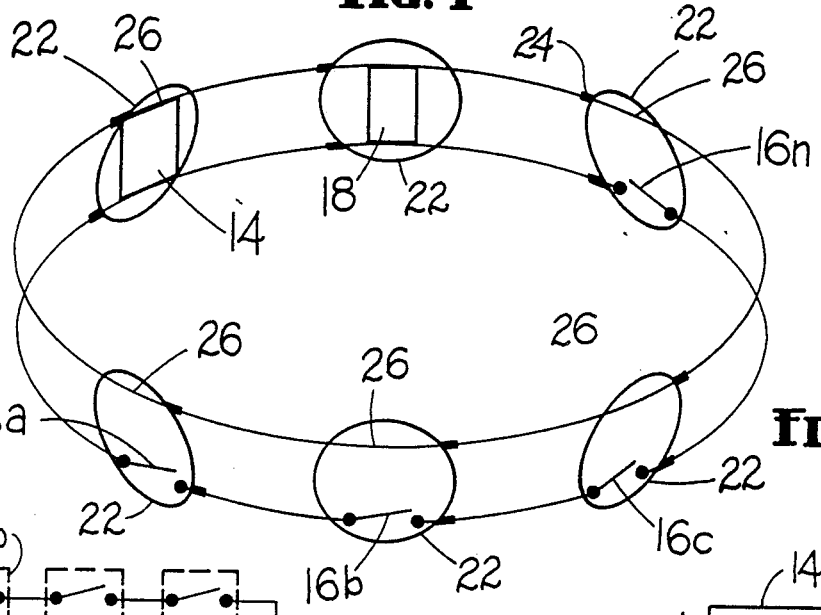
FIG. 5 is an general, highly schematic view of another preferred embodiment of the invention, disclosing a convenient means of mounting the switch means and attaching them together.

FIG. 5 discloses another form 22 of fixture that lends itself to a less intrusive means of containing the circuit of the invention.

In this embodiment of the invention, position-sensitive switch means 16*a* . . . 16*n* are contained in small adhesive-backed patches 22 and placed directly on the skin of the patient as desired. Connections can be by any of several well-known types of connectors 24, including those fabricated directly as a part of the patch, as shown. Energy source means 14 and alarm or indicator means 18 could also be included on similar patches.

This arrangement would permit a significant improvement over previous alarm systems and over the embodiments disclosed in FIGS. 3 and 4. If a parallel conductor 26 is included on the patches, as shown, and connected appropriately into alarm circuit 18, whenever the patient deliberately or inadvertently pulled the connectors apart, and attendants alerted, avoiding the confusion accompanying an inoperative alarm .

The terms and expressions which have been employed in the foregoing description are used therein as terms of description rather than as terms of limitation, and there is no intention, in the use of such terms and expressions, of excluding equivalents of the features shown and described or portions thereof, it being recognized that the scope of the invention is defined and limited only by the claims which follow.

What I claim as my invention is:

1. A circuit for actuating an alarm when a recumbent patient rises to an upright position, said circuit including:

I. indicator means including alarm means;

II. energy source means;

III. a multiplicity of position-sensitive switch means, said switch means;

A. being arranged at spaced intervals about the chest of said patient;

B. having a first state and a second state and being in said second state when said patient is in said upright upright position;

C. being connected to said source means and said indicator means so that said indicator means is activated when all of said switch means are in said second state, and not otherwise, comprising:

said indicator means, said energy source means and said position-sensitive switch means being mounted on adhesive patches placed at said intervals around said patient's chest and being interconnected to form said circuit.

2. Apparatus for actuating an alarm when a patient rises to an upright position, said apparatus adapted to be placed about the body of said patient, comprising:

a. indicator means including alarm means;

b. energy source means;

c. at least a plurality of position sensitive switch means, said switch means:

1. being arranged at spaced intervals about the body portion of said patient;

2. having a first state and a second state and being in said second state when said patient is in an upright position; and 3. being connected to said source means and said indicator means so that said indicator means is activated when all of said switch means are in said second state and not otherwise; and d. at least one of:

1. said indicator means;

2. said energy source means; or 3. said switch means, being incorporated in adhesive patches affixed to said patient's body.

3. The apparatus of claim 2, wherein said indicator means, said energy source means, and said switch means are each incorporated in adhesive patches to be affixed about said patient's body to appropriate portions thereof.

4. Apparatus forming a circuit for actuating an alarm when a patient rises to an upright position, said apparatus adapted to be arranged about a portion of the body of said patient, including:

a. indicator means including alarm means;

b. energy source means;

c. at least a plurality of position sensitive switch means, wherein said switch means:

1. are arranged at spaced intervals about the body portion of said patient when said apparatus is worn thereby;

2. have a first state and a second state and are in said second state when said patient is in said upright position;

3. are connected to said source means and said indicator means so that said indicator means is activated when all of said switch means are in said second state and not otherwise, comprising:

a. each of said indicator means, said energy source means, and said switch means being incorporated into adhesive patches arranged at said spaced intervals about said portion of said patient's body.

5. Apparatus forming a circuit for actuating an alarm when a patient rises to an upright position, said apparatus adapted to be arranged about a portion of the body of said patient, including:

a. indicator means including alarm means;

b. energy source means;

c. a multiplicity of position sensitive switch means, said switch means:

1. are arranged at spaced intervals about the body portion of said patient when said apparatus is worn thereby:

2. have a first state and a second state and are in said second state when said patient is in said upright position;

3. are connected to said source means and said indicator means so that said indicator means is activated when all of said switch means are in said second state and not otherwise, comprising:

a. each of said indicator means, said energy source means, and said switch means being incorporated into adhesive patches arranged at said spaced intervals about said portion of said patient's body.

6. A fixture containing a circuit for actuating an alarm when a patient rises to an upright position, said fixture adapted to fit about a portion of the body of said patient, comprising:

a. indicator means including alarm means;

b. energy source means;

c. at least a plurality of position sensitive switch means, said switch means:

1. being arranged at spaced intervals about the body portion of said patient when said fixture is worn thereby;

2. having a first state and a second state and being in said second state when said patient is in an upright position;

3. being connected to said source means and said indicator means so that said indicator means is activated when all of said switch means are in said second state and not otherwise.

7. A fixture containing a circuit for actuating an alarm when a patient rises to an upright position, said fixture adapted to fit about a portion of the body of said patient, comprising:

a. indicator means including alarm means;

b. energy source means;

c. a multiplicity of position sensitive switch means, said switch means:

1. being arranged at spaced intervals about the body portion of said patient when said fixture is worn thereby;

2. having a first state and a second state and being in said second state when said patient is in an upright position;

3. being connected to said source means and said indicator means so that said indicator means is activated when all of said switch means are in said second state and not otherwise.

8. The fixture of claim 6 or 7, comprising: a belt for placing about the trunk of said patient's body.

9. The fixture of claim 6 or 7, comprising: a garment for locating said circuit around the trunk of said patient's body.

10. The fixture of claim 6 or 7, wherein said indicator means includes a visual alarm means.

11. The fixture of claim 6 or 7, wherein said indicator means includes an audible alarm means.

12. The fixture of claim 6 or 7, wherein said indicator means includes a tactile alarm means.

13. The fixture of claim 6 or 7, comprising: a cuff for wrapping around the upper portion of a limb of said patient.

* * * * *